US007991344B2

(12) United States Patent
Naruse

(10) Patent No.: US 7,991,344 B2
(45) Date of Patent: Aug. 2, 2011

(54) WASTE POWDER RECOVERING DEVICE AND IMAGE FORMING APPARATUS

(75) Inventor: Akira Naruse, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 12/640,066

(22) Filed: Dec. 17, 2009

(65) Prior Publication Data

US 2010/0158590 A1 Jun. 24, 2010

(30) Foreign Application Priority Data

Dec. 19, 2008 (JP) ..... 2008-323957

(51) Int. Cl.
*G03G 21/10* (2006.01)

(52) U.S. Cl. ..... 399/358; 399/120; 399/360

(58) Field of Classification Search ..... 399/358, 399/360, 120, 256, 263, 257
See application file for complete search history.

(56) References Cited

U.S. PATENT DOCUMENTS

| | | | | |
|---|---|---|---|---|
| 2006/0120779 | A1* | 6/2006 | Uchihashi | 399/358 |
| 2009/0123189 | A1* | 5/2009 | Ichiki et al. | 399/257 |
| 2009/0136259 | A1* | 5/2009 | Ito | 399/120 |

FOREIGN PATENT DOCUMENTS

| | | | |
|---|---|---|---|
| JP | 5-023437 | B2 | 4/1993 |
| JP | 08-328366 | | 12/1996 |
| JP | 11-161124 | A | 6/1999 |
| JP | 2002-148884 | | 5/2002 |
| JP | 2008-077115 | A * | 4/2008 |
| JP | 2008-122662 | A | 5/2008 |
| JP | 2008-134279 | A | 6/2008 |
| JP | 2008-134398 | | 6/2008 |
| JP | 2009-063765 | A * | 3/2009 |

OTHER PUBLICATIONS

Official Action dated Sep. 21, 2010, issued in the corresponding Japanese Patent Application No. 2008-323957, and an English Translation thereof.

Office Action issued May 17, 2011, in corresponding Japanese Patent Application No. 2008-323957, and English language translation thereof.

* cited by examiner

*Primary Examiner* — Sophia S Chen
(74) *Attorney, Agent, or Firm* — Buchanan Ingersoll & Rooney PC

(57) ABSTRACT

A recovery port, through which waste powder is recovered, is formed at one end of a waste powder recovery container. A conveying member for conveying the waste powder, which has been recovered through the recovery port, from one end to the other end is disposed inside the waste powder recovery container. The conveying member includes a first conveying portion positioned on a side of the recovery port, for conveying the waste powder to the other end, and a second conveying portion for dispersing in a widthwise direction the waste powder conveyed by the first conveying portion.

13 Claims, 9 Drawing Sheets

WASTE POWDER RECOVERING DEVICE AND IMAGE FORMING APPARATUS

This application is based on JP2008-323957.

BACKGROUND OF THE INVENTION

1. Field of the Invention

The present invention relates to a waste powder recovering device and an image forming apparatus.

2. Description of the Related Art

There have been conventionally known waste powder recovering devices for use in an image forming apparatus, having configurations as follows.

Japanese Examined Patent Publication No. 5-23437 discloses a waste powder recovering device in which spiral portions of conveying means housed inside a waste powder recovery container are independently disposed, so that waste powder can be uniformly accumulated in the waste powder recovery container.

Alternatively, Japanese Unexamined Patent Publication No. 11-161124 discloses a waste powder recovering device in which a spiral portion of conveying means housed inside a waste powder recovery container is formed only on a side of a toner recovery port in a projection region of a full-state detector, so that interference with rotation of the conveying means can be prevented.

However, in each of the above-described waste powder recovering devices, the spiral portion is not wholly but partly disposed, and therefore, the waste powder is partly conveyed toward a rotary shaft. As a result, the waste powder is insufficiently dispersed in a direction perpendicular to a conveyance direction. In a wide recovery container, the waste powder is not recovered in a uniform manner.

SUMMARY OF THE INVENTION

The present invention has been accomplished to solve the above-described problem, and an object of the present invention is to provide a waste powder recovering device capable of uniformly containing recovered waste powder not only in a conveyance direction but also in a widthwise direction, and an image forming apparatus.

To solve the above-described problem, in the present invention, there is provided a waste powder recovering device provided with a waste powder recovery container, the device including: a recovery port, through which a waste powder is recovered, formed at one end of the waste powder recovery container; and a conveying member for conveying the waste powder, which has been recovered through the recovery port, from one end to the other end, the conveying member disposed inside the waste powder recovery container, wherein the conveying member includes a first conveying portion positioned on a side of the recovery port, for conveying the waste powder to the other end, and a second conveying portion for dispersing the waste powder conveyed by the first conveying portion in a widthwise direction.

With this configuration, the first conveying portion can convey the waste powder, which has been recovered into the waste powder recovery container through the recovery port at one end, toward the other end. The second conveying portion can disperse the waste powder, which has been conveyed by the first conveying portion, in a widthwise direction. As a result, the waste powder can be recovered in the waste powder recovery container while suppressing any generation of unevenness.

Preferably, the conveying member is made of a wire rod rotatably supported at both ends thereof by both ends of the waste powder recovery container, the first conveying portion being configured by a spiral portion obtained by bending the wire rod into a spiral form, and the second conveying portion being configured by a straight portion disposed eccentrically from the rotational center of the conveying member.

With this configuration, it is possible to prevent any unevenness of the waste powder recovered in the waste powder recovery container with the simple and inexpensive configuration obtained only by bending the wire rod.

Preferably, the conveying member further includes a second spiral portion which is positioned on a side opposite to the recovery port and wound reversely to the spiral portion.

With this configuration, it is possible to alleviate the pressure of the waste powder acting at the end (the bearing portion) rotatably supported in the waste powder recovery container on a side opposite to the spiral portion, so as to prevent any leakage of the recovered waste powder or any deficient rotation of the conveying member.

Preferably, the waste powder recovering container includes a powder detecting member formed into an elongated and grooved recess extending in a vertical direction at a side opposite to the recovery port and detecting the waste powder which is dispersed in the widthwise direction by the second conveying portion and is contained into the recess while being agitated from above to below; and a determining member for determining whether or not the waste powder is contained up to a predetermined level inside the waste powder recovering container based on a detection result by the powder detecting member.

With this configuration, the powder detecting member can detect the waste powder which has been dispersed in the widthwise direction in a uniform height by the second conveying portion, so as to prevent any erroneous detection.

Preferably, the waste powder recovering container is vertically bisected, an upper space being a toner recovery chamber, into which a toner is recovered, and a lower space being a developer recovery chamber, into which a developer is recovered and in which the recovery port and the conveying member are housed.

With this configuration, even if the developer is forced to be recovered at the lower position, the developer can be securely recovered without undue labor in the developer recovery chamber housing therein the conveying member including the first conveying portion and the second conveying portion. Furthermore, even if the developer recovery chamber becomes greater in width than in height by vertically bisecting the waste powder recovery container, the developer can be securely dispersed by the second conveying portion in a widthwise direction, thus preventing any generation of a vacant space which is not used.

Moreover, the present invention provides an image forming apparatus including any one of the above-described waste powder recovering devices as means for solving the above-described problem.

According to the present invention, the first conveying portion is provided for conveying the recovered waste powder from one end to the other end and the second conveying portion is provided for dispersing the waste powder in the widthwise direction perpendicular to the conveyance direction, so that the waste powder can be uniformly recovered inside the waste powder recovery container without any unevenness.

DESCRIPTION OF THE PREFERRED EMBODIMENTS

A description will be given below of preferred embodiments according to the present invention with reference to the attached drawings. In the description below, kinds, combinations, shapes, relative arrangements, and the like of components do not restrict the technical scope of the present invention, unless specifically stated. In addition, although terms indicating specific directions or positions (including "upper," "lower," "one end," and "the other end") are appropriately used, as required, the terms are used for the sake of easy understanding of the invention with reference to the attached drawings and do not restrict the technical scope of the present invention.

1. Configuration

Figure 1:
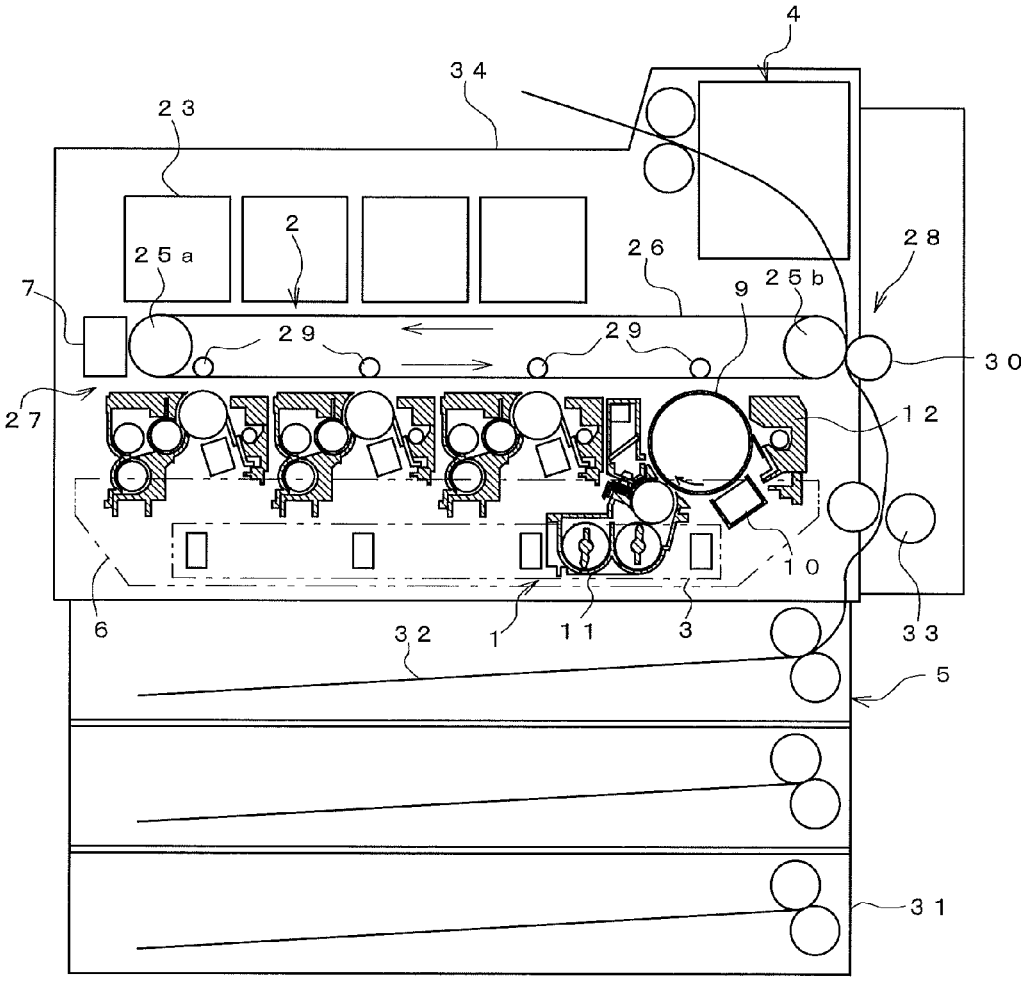
FIG. 1 is a front view schematically showing an image forming apparatus according to the present embodiment.

FIG. 1 shows an image forming apparatus of a so-called trickle system, in particular, in which not only a toner but also a developer is replenished, among electrophotographic systems using a two-component developer. The image forming apparatus includes an image forming unit 1, a transferring unit 2, an exposing unit 3, a fixing unit 4, a sheet feeding unit 5, a waste powder recovery container 6, a cleaning unit 7, a control unit 8 (see FIG. 4), and the like. In this case, the image forming apparatus may be any of a copying machine, a printer, a facsimile, and a composite machine compositely equipped with functions thereof.

(1-2. Image Forming Unit)

Four image forming units 1 are arranged along an intermediate transfer belt 26 in the transferring unit 2, to perform formation of images of yellow (Y), magenta (M), cyan (C), and black (Bk) colors from the left, so as to form a color image on the surface of the intermediate transfer belt 26. Each of the image forming units 1 includes a charger 10, a developing device 11, a cleaner 12, and the like around a photosensitive drum 9, as shown in FIG. 2.

The charger 10 makes a predetermined surface potential on the photosensitive drum 9. The surface potential forms an electrostatic latent image by exposure by the use of the exposing unit 3. Although a scorotron charger of a non-contact type is used as the charger 10 herein, a charger of a contact type such as a blade- or brush-like charger or a charging roller may be used.

Figure 2A:
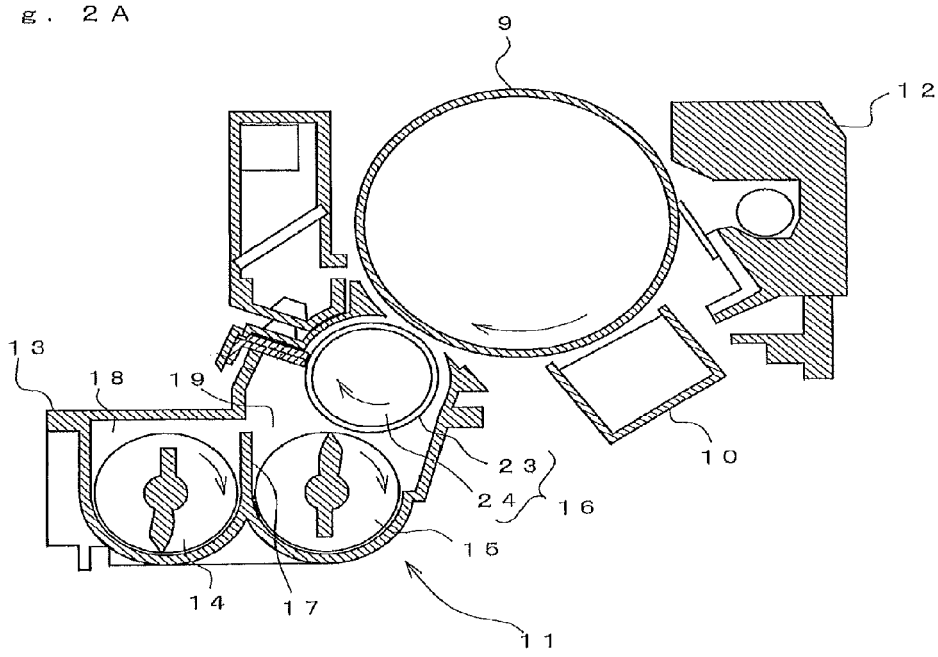
FIGS. 2A and 2B are front cross-sectional views schematically showing an image forming unit shown in FIG. 1.

As shown in FIG. 2A, the developing device 11 contains an agitating screw 14, a supplying screw 15, and a developing roller 16 inside a developer container 13.

Figure 2B:
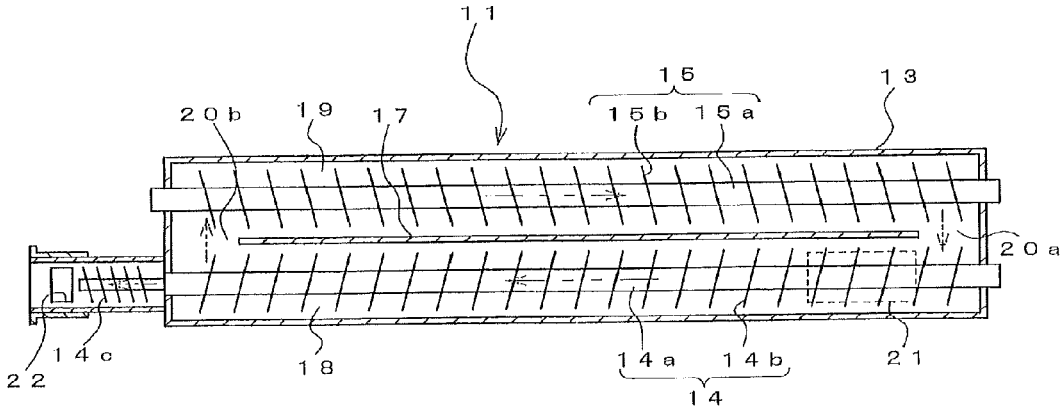

As shown in FIG. 2B, the developer container 13 is formed into an elongated box extending from one end to the other end. The inside of the developer container 13 is bisected into a first storage portion 18 and a second storage portion 19 in a longitudinal direction by a first partition wall 17. Both ends of the first storage portion 18 and both ends of the second storage portion 19 communicate with each other via communicating portions 20*a* and 20*b*, respectively. The contained developer is designed to be circulated and moved while being agitated.

A developer replenishing port 21 is formed at one end of the first storage portion 18, and thus, is replenished with the developer from a corresponding developer replenishing container 23, as described below. In this case, a two-component developer incorporating a toner and a carrier is used as the developer. The developer may incorporate an additive. A developer discharging port 22 is formed at the other end of the first storage portion 18. The developer is appropriately discharged, so that a degraded carrier does not remain inside the developer container 13 for a long period of time.

The agitating screw 14 is disposed in the first storage portion 18, and includes a first spiral blade 14*b* extending from one end to the other end around a rotary shaft 14*a* and a second blade 14*c* wound reversely to the first blade 14*b* at the other end. When the agitating screw 14 is rotationally driven, the first blade 14*b* agitates the developer while conveying it from the communicating portion 20*a* to the communicating portion 20*b*, and further, the second blade 14*c* applies a predetermined resistant pressure onto the developer flowing to the developer discharging port 22. As a result, only an excess developer is discharged through the developer discharging port 22.

The supplying screw 15 is disposed in the second storage portion 19, and includes a spiral blade 15*b* around a rotary shaft 15*a*. When the supplying screw 15 is rotationally driven, the supplying screw 15 conveys the developer from the communicating portion 20*b* to the communicating portion 20*a*, and further, supplies the developer to the developing roller 16.

The developing roller 16 houses a plurality of permanent magnets 24 inside a cylindrical sleeve 23 (in this case, five permanent magnets S2, N2, S1, N1, and S3 (not shown) are arranged clockwise in this order). The sleeve 23 is designed to be rotated in a direction indicated by an arrow in FIG. 2A by a sleeve drive member (not shown).

As shown in FIG. 1, the transferring unit 2 is configured such that the transferring unit 2 is configured such that the intermediate transfer belt 26 is stretched across a pair of support rollers 25*a* and 25*b*, and then, is moved around by a drive member (not shown) in a direction indicated by an arrow. The transferring unit 2 includes a primary transferring unit 27 and a secondary transferring unit 28. The primary transferring unit 27 includes primary transferring rollers 29 facing the photosensitive drum 9 while holding the intermediate transfer belt 26 therebetween. The primary transferring roller 29 applies a positive voltage to the back surface of the intermediate transfer belt 26. In the meantime, the secondary transferring unit 28 includes a secondary transferring roller 30 facing the support roller 25*b*. The secondary transferring roller 30 applies a positive voltage to the back surface of the intermediate transfer belt 26. A toner image transferred onto the intermediate transfer belt 26 is transferred onto a recording medium 32 (e.g., a sheet of paper).

The cleaner 12 recovers the toner remaining on the surface of the photosensitive drum 9 after the toner is transferred onto the transfer belt from the surface of the photosensitive drum 9.

The recovered toner is discarded to a toner recovery chamber 36 in the waste powder recovery container 6, described below, by a waste screw (not shown) through a toner discharging port (not shown) formed in the cleaner 12. Note that the cleaner 12 is not limited to a blade, but other cleaning members (e.g., a fixing brush, a rotary brush, and a roller) may be used. In addition, a plurality of cleaners 12 may be used together, or the cleaner 12 may adopt a cleaner-less system in which the developing device 11 may recover a not-transferred toner in place of the cleaner 12.

(1-3. Exposing Unit)

The exposing unit 3 irradiates the photosensitive drum 9 with a laser beam, thereby forming an electrostatic latent image corresponding to image data read by a scanner (not shown). The exposing unit 3 may be exemplified by a laser, a light emitting diode, or the like.

(1-4. Fixing Unit)

The fixing unit 4 rotatably supports a fixing roller and a pressurizing roller (neither shown). The fixing roller is made of a conductive material, is rotatably driven by a motor (not shown) and is inductively heated by an exciting coil (not shown). The pressurizing roller is brought into press-contact with the fixing roller, and the recording medium 32 is held between the pressurizing roller and the fixing roller. Accordingly, the toner transferred in the transferring unit 2 can be fixed onto the recording medium 32.

(1-5. Sheet Feeding Unit)

The sheet feeding unit 5 sequentially feeds the recording mediums 32, which are stacked in a cassette 31, to the secondary transferring unit 28 via a plurality of feed rollers 33. Thereafter, the toner image is transferred onto the recording medium 32 in the secondary transferring unit 28. The transferred toner image is then fixed to the recording medium 32 in the fixing unit 4. Finally, the recording medium 32 is discharged onto a discharge tray 34.

(1-6. Waste Powder Recovery Container)

Figure 4:
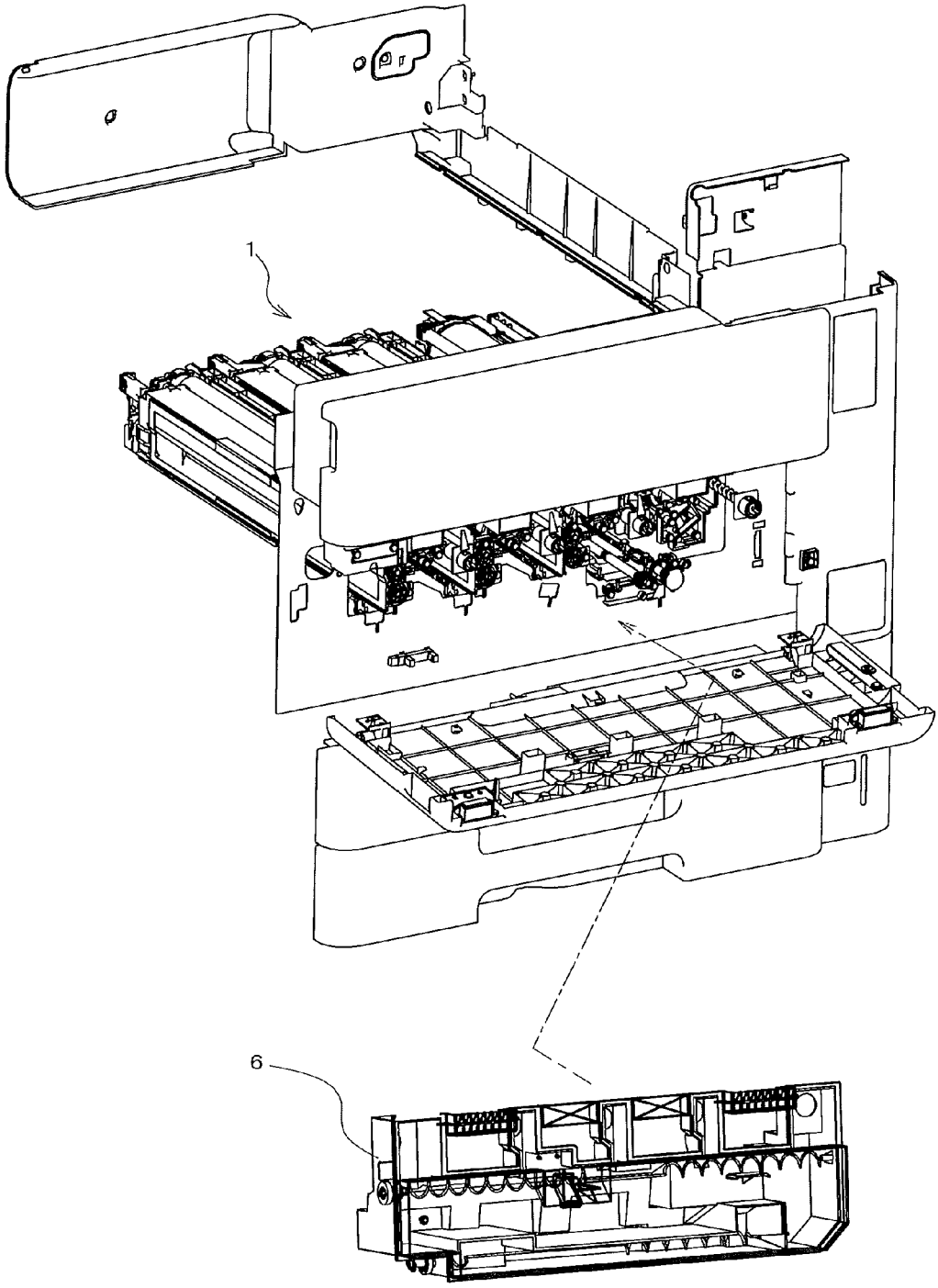
FIG. 4 is a block diagram showing the image forming apparatus according to the present embodiment.
Figure 5:
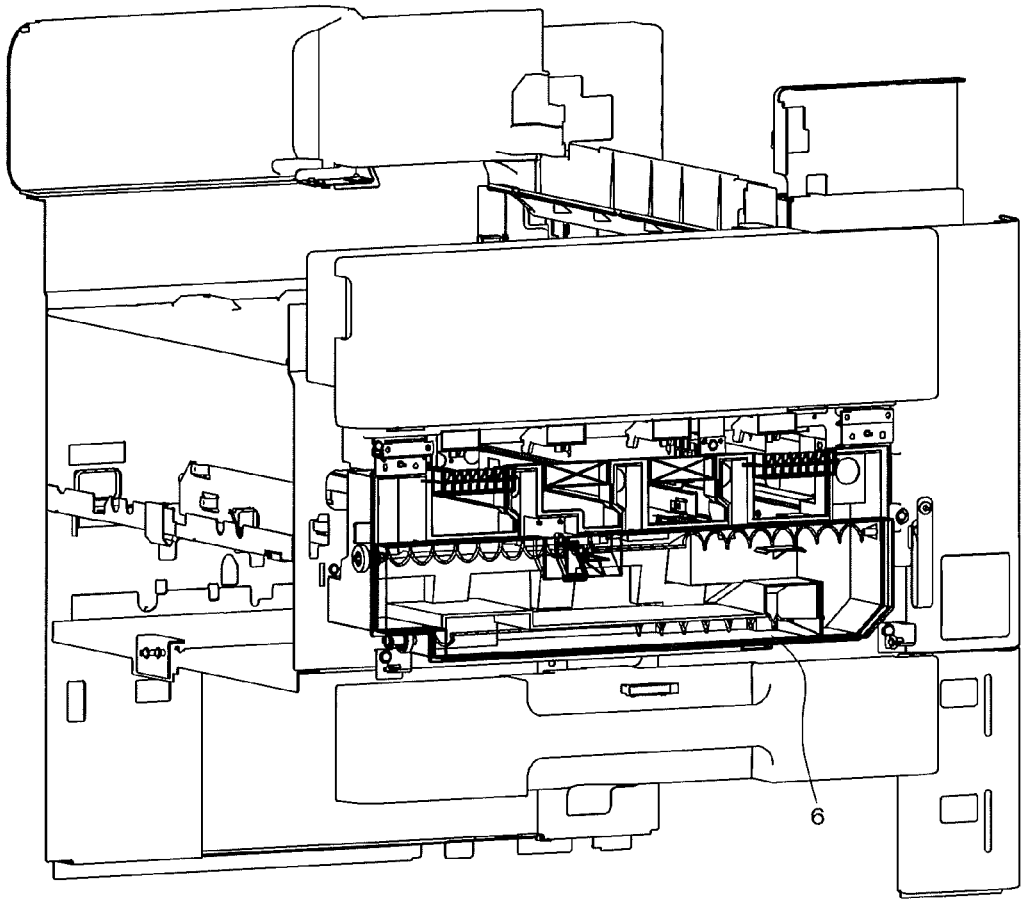
FIG. 5 is a partial perspective view showing a waste powder recovery container detached from the image forming apparatus according to the present embodiment.
Figure 6A:
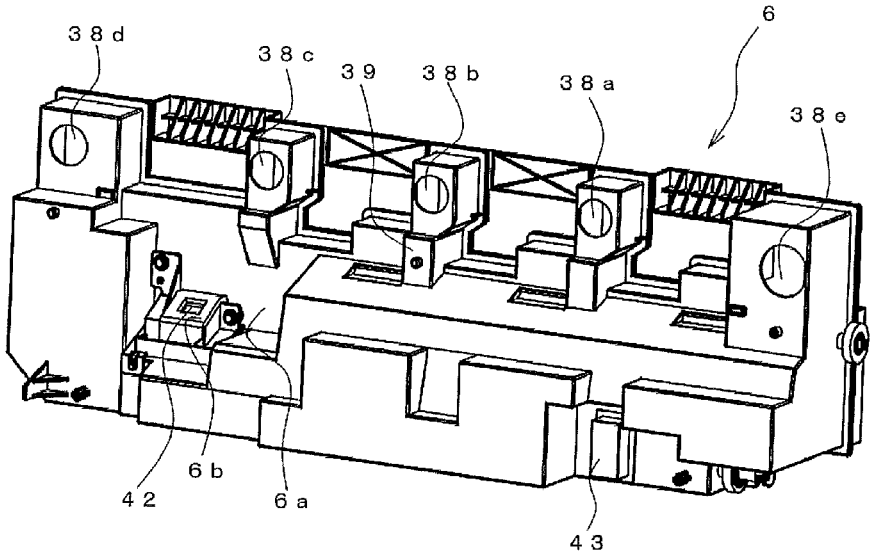
FIGS. 6A and 6B are partial perspective views showing the waste powder recovery container attached to the image forming apparatus according to the present embodiment.
Figure 6B:
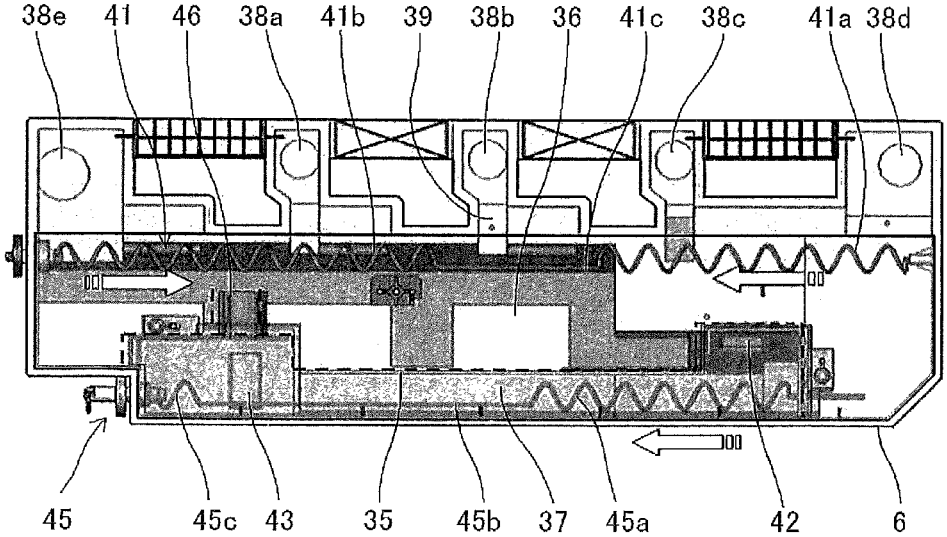

As shown in FIGS. 4 and 5, the waste powder recovery container 6 is detachably attached in a lower space in the image forming unit 1. As shown in FIG. 6B, the inner space is vertically bisected via a second partition wall 35. A defined upper space serves as the toner recovery chamber 36 whereas a lower space serves as a developer recovery chamber 37.

The toner recovery chamber 36 is provided with toner recovery ports 38*a*, 38*b*, 38*c*, and 38*d* to be connected to the image forming units 1 for the yellow (Y), magenta (M), cyan (C), and black (Bk) colors and a toner recovery port 38*e*, through which the residual toner on the intermediate transfer belt 26 recovered by the cleaning unit 7 is recovered. All of the toner recovery ports 38*a*, 38*b*, 38*c*, 38*d*, and 38*e* communicate with the toner recovery chamber 36.

Moreover, the toner recovery chamber 36 is provided with a first detector 39 which has translucency and projects sideways. A waste toner detecting sensor 40 consisting of a light emitting element and a light receiving element is adapted to detect, at both side surfaces facing a projecting portion, whether or not the developer inside the first detector 39 is in a "near-full" state. In other words, when the toner can only be recovered into the toner recovery chamber 36 in a predetermined remaining quantity, the first detector 39 cannot transmit the light emitted from the light emitting element, so that the "near-full" state can be detected. The term "near-full" refers to a predetermined quantity (90% of the capacity) before reaching a full state.

Figure 7A:
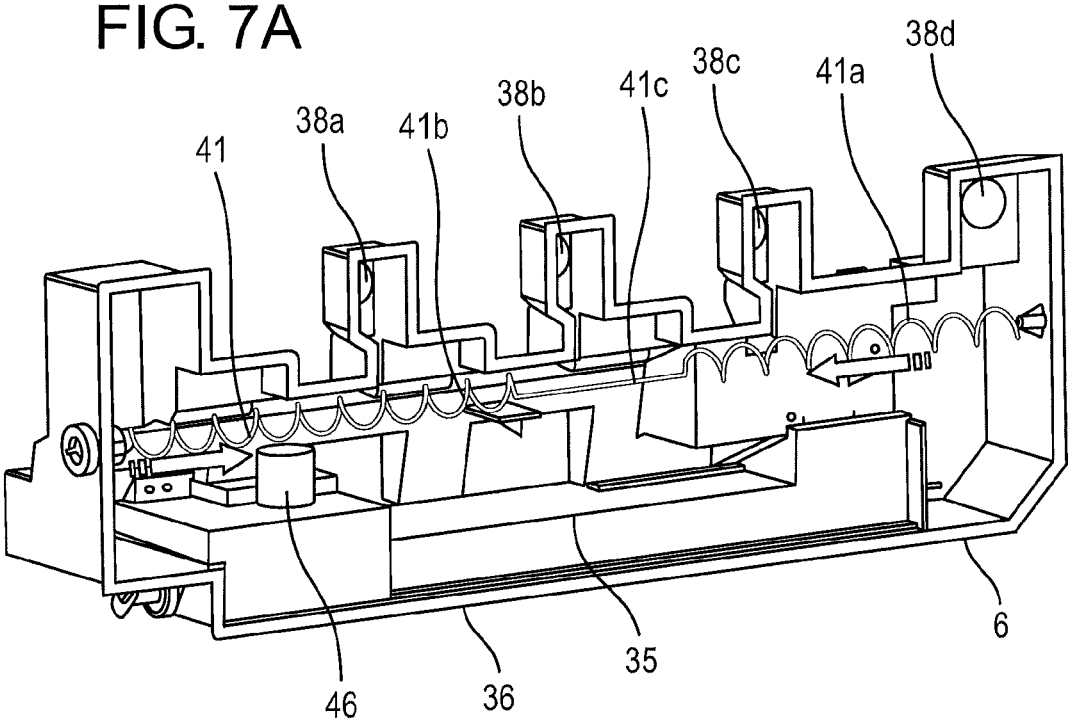
FIGS. 7A and 7B are perspective views showing the waste powder recovery container shown in FIGS. 5, 6A, and 6B.
Figure 8A:
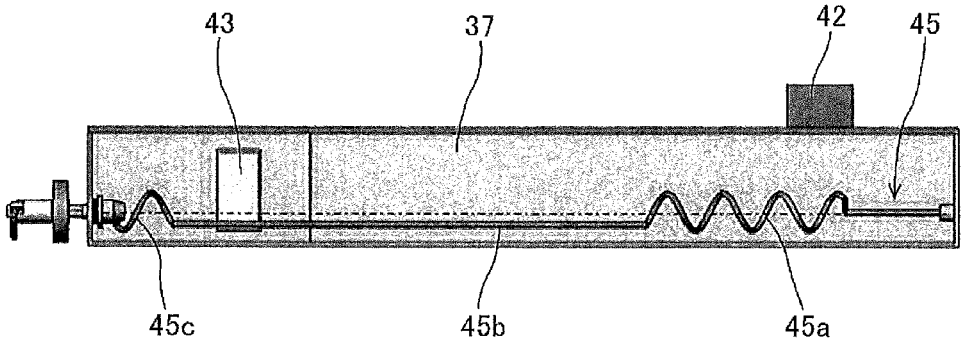
FIGS. 8A to 8C are cross-sectional perspective views showing the waste powder recovery container shown in FIGS. 7A and 7B, as viewed from an opposite side.

Furthermore, a toner agitating coil 41 formed by bending a wire rod is housed inside the toner recovery chamber 36, as shown in FIG. 8A. The toner agitating coil 41 is rotatably supported at both ends thereof through both end walls of the toner recovery chamber 36. A first spiral portion 41*a* and a second spiral portion 41*b* are formed at both ends of the toner agitating coil 41 inward of the supported portions, respectively. The first spiral portion 41*a* and the second spiral portion 41*b* are wound reversely to each other. A straight portion 41*c* displaced from the rotational center of the toner agitating coil 41 is formed between the first spiral portion 41*a* and the second spiral portion 41*b*. The toner agitating coil 41 is rotated in a direction in which the toner is conveyed toward the straight portion 41*c* by the first spiral portion 41*a* and the second spiral portion 41*b*, as shown in FIG. 7A. The straight portion 41*c* disperses in a widthwise direction the toner conveyed by the first spiral portion 41*a* and the second spiral portion 41*b* (i.e., in a depth direction in FIG. 9).

In contrast, the developer recovery chamber 37 is provided with a developer recovery port 42 connected to the developer discharging port 22 formed in the image forming unit 1 for the black (Bk) color. As shown in FIG. 6A, the developer recovery port 42 is opened to an inclined surface 6*b* formed on a step 6*a* formed at the side surface of the waste powder recovery container 6.

On a side portion of the developer recovery chamber 37, there is disposed a recessed second detector 43, which has translucency and projects to the side, formed into a vertically elongated groove extending in a vertical direction. Whether or not the developer inside the second detector 43 is in a "near-full" state is detected by a waste developer detecting sensor 44 (see FIG. 9), which includes a light emitting element and a light receiving element, through both opposing side surfaces of the projecting portion, like the waste toner detecting sensor 40.

Moreover, a developer agitating coil 45 formed by bending a wire rod is housed inside the developer recovery chamber 37. The developer agitating coil 45 is rotatably supported at both ends thereof via both end walls of the developer containing chamber, to be rotated by a drive member (not shown). The developer agitating coil 45 includes a first spiral portion 45*a* at one end thereof positioned in the vicinity of the developer recovery port 42, a straight portion 45*b* extending toward the other end thereof from the first spiral portion 45*a*, and a second spiral portion 45*c* formed at the other end and wound reversely to the first spiral portion 45*a*. The first spiral portion 45*a* conveys the developer toward the other end while agitating the developer recovered inside the developer recovery chamber 37 through the developer recovery port 42. The straight portion 45*b* is displaced from the rotational center of the developer agitating coil 45. When the developer agitating coil 45 is rotated, the developer conveyed by the first spiral portion 45*a* is dispersed in the widthwise direction by the straight portion 45*b*. The second spiral portion 45*c* is located in the vicinity of a bearing portion rotatably supported on the other end wall of the developer recovery chamber. The second spiral portion 45*c* is rotated, thereby alleviating a pressure of the developer acting on the bearing portion. As a result, it is possible to prevent any leakage of the developer from the bearing portion or any interference with the rotation of the developer agitating coil 45.

Figure 7B:
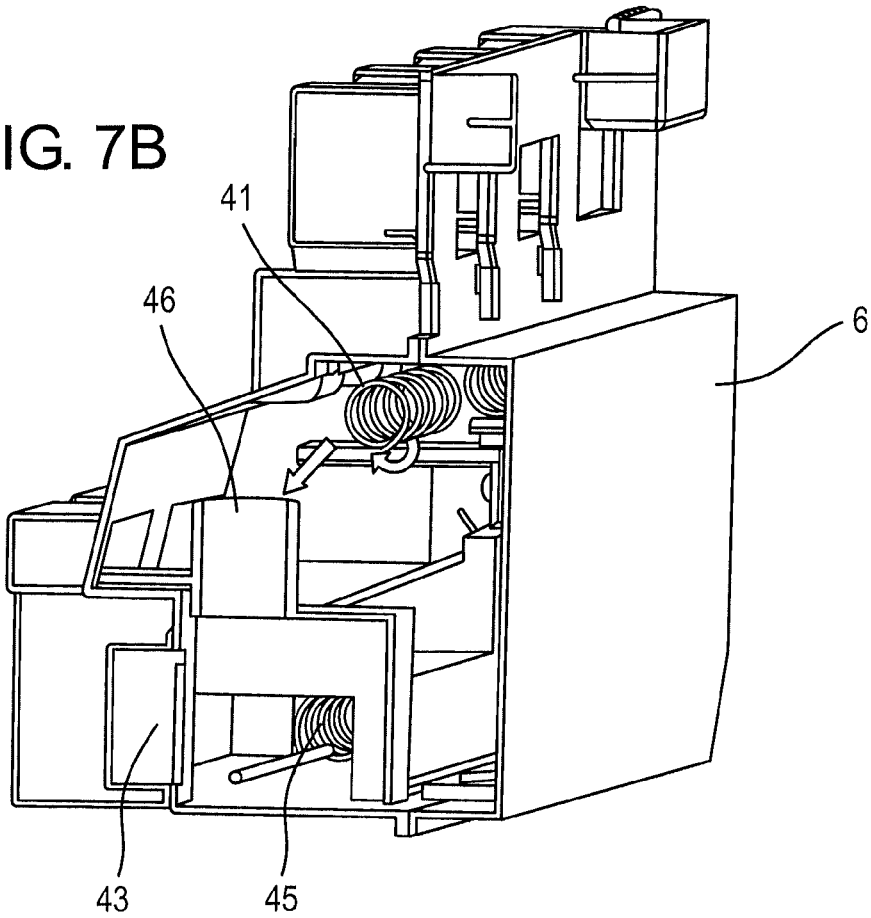

As shown in FIGS. 6B, 7A, and 7B, the toner recovery chamber 36 and the developer recovery chamber 37 communicate with each other via a cylindrical portion 46 formed on the second partition wall 35. The cylindrical portion 46 is formed at an end opposite to the developer recovery port 42, and projects toward the toner recovery chamber 36. The capacity of each of the toner recovery chamber 36 and the developer recovery chamber 37 is determined based on experiments, experimental values, or the like, such that the toner recovery chamber 36 first comes to the "near-full" state, and then, the developer recovery chamber 37 comes to the "near-full" state. Therefore, when the toner recovery chamber 36 is in the "near-full" state before it is full ("full" state), the toner remaining inside the toner recovery chamber 36 flows down into the developer recovery chamber 37, which still has room for a recovery space, through the cylindrical portion 46.

In the above-described embodiment, the toner agitating coil 41 and the developer agitating coil 45 disposed in the waste powder recovery container 6 can be inexpensively and easily fabricated only by bending the wire rods. Note that each of the coils 41 and 45 may be constituted by a screw having a spiral blade disposed on a rotary shaft. Specifically, a spiral blade and a plate-like paddle may be disposed on a rotary shaft, the blade functioning as the first spiral portion 45*a* of the developer agitating coil 45 whereas the paddle functioning as the straight portion 45*b*.

(1-7. Cleaning Unit)

The cleaning unit 7 can be brought into or out of contact with the intermediate transfer belt 26. When the cleaning unit 7 approaches the intermediate transfer belt 26, it recovers the toner remaining on the intermediate transfer belt 26 so as to clean the intermediate transfer belt 26.

(1-8. Control Unit)

Figure 3:
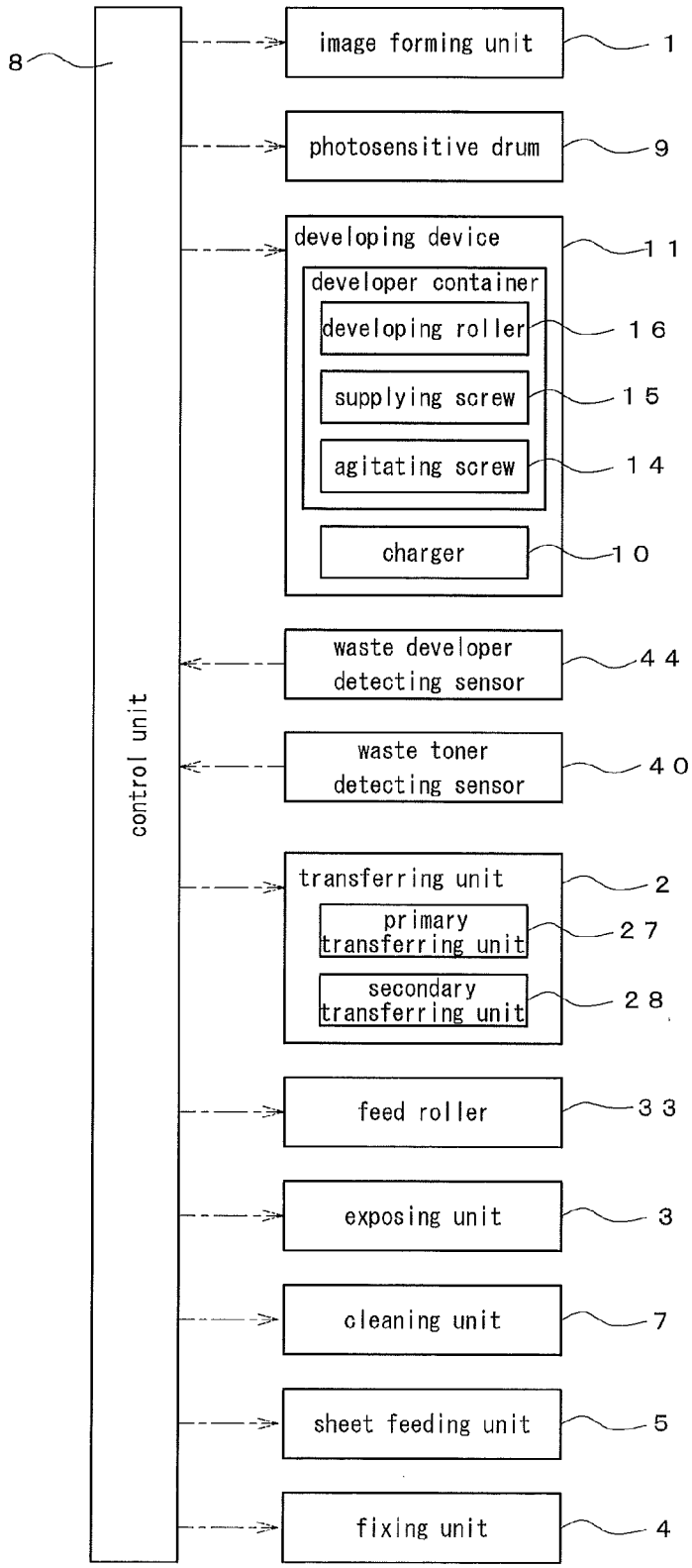
FIG. 3 is a cross-sectional plan view schematically showing a developing device shown in FIG. 2.

The control unit 8 detects the recovery state, that is, the "near-full" state of the toner or developer in the toner recovery chamber 36 or the developer recovery chamber 37 in the waste powder recovery container 6 based on an ON signal inputted from the waste toner detecting sensor 40 or the waste developer detecting sensor 44, and then, predicts the "full" state based on a predetermined count, as described below (see FIG. 3).

2. Operation

Next, a description will be given of an operation of the image forming apparatus 1 having the above-described configuration.

Color print data obtained by reading an image by an image reading unit (not shown) or image data inputted from a personal computer or the like is subjected to a predetermined signal processing in the control unit 8, to be then inputted into the image forming apparatus 1. The image forming apparatus 1 modulates a laser beam based on the inputted image data, and then, projects the laser beam on the photosensitive drum 9, so as to form a latent image.

In each of the image forming units 1 for supplying the color toners, the waste toner is recovered from the photosensitive drum 9 in the cleaner 12. The waste toner recovered in the cleaner 12 is recovered to the toner recovery chamber 36 through the toner recovery ports 38*a* to 38*d* in the waste powder recovery container 6. In contrast, the toner recovered from the intermediate transfer belt 26 in the cleaning unit 7 is recovered to the toner recovery chamber 36 through the toner recovery port 38*e*.

In the image forming unit 1 for supplying the black (Bk) toner, the developer is replenished into the first storage portion 18 in the developer container 13. The replenished developer is sequentially conveyed in an axial direction by the first blade 14*b* by the rotation of the agitating screw 14. The developer conveyed at one end receives a reversal pressure (i.e., a resistant pressure) by the second blade 14*c*. An excess developer (i.e., a waste developer) having a pressure greater than the resistant pressure is discharged from the developer discharge port 22 to the developer recovery chamber 37 in the waste powder recovery container 6 through the developer recovery port 42 whereas the residual developer is conveyed to the second storage portion 19 through the second communicating portion 20*b*. In the second storage portion 19, the developer is supplied to the developing roller 16 while being agitated by the supplying screw 15, and then, is returned to the first storage portion 18 through the first communicating portion 20*a*, to be circulated therein.

In the waste powder recovery container 6, from the start to the end of the image forming processing, the toner agitating coil 41 is rotated in the toner recovery chamber 36 by the motor (not shown), whereas the developer agitating coil 45 is rotated in the developer recovery chamber 37 by the motor (not shown).

The toner recovered through the toner recovery ports 38*a* to 38*e* is accumulated in the toner recovery chamber 36. When the accumulated toner reaches the rotational region of the toner agitating coil 41, the toner is conveyed to the center by the first spiral portion 41*a* and the second spiral portion 41*b* while being agitated, as shown in FIG. 7A. At the center, the toner is leveled off in a widthwise direction by the straight portion 41*c*. The first detector 39 detects whether or not the toner in the toner recovery chamber 36 is in the "near-full" state.

Figure 8B:
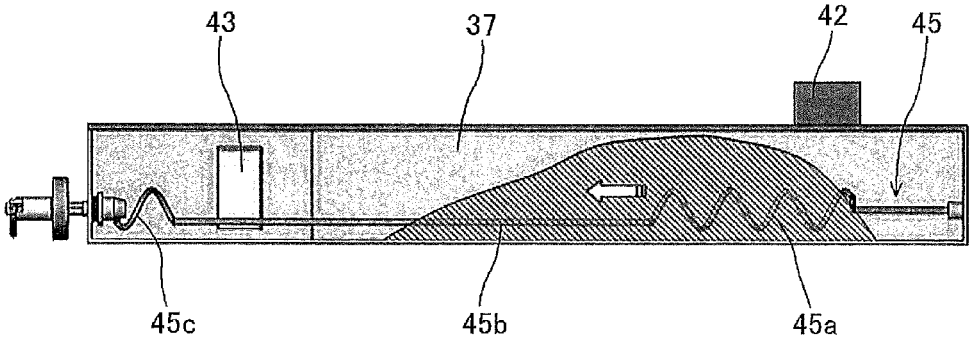
Figure 8C:
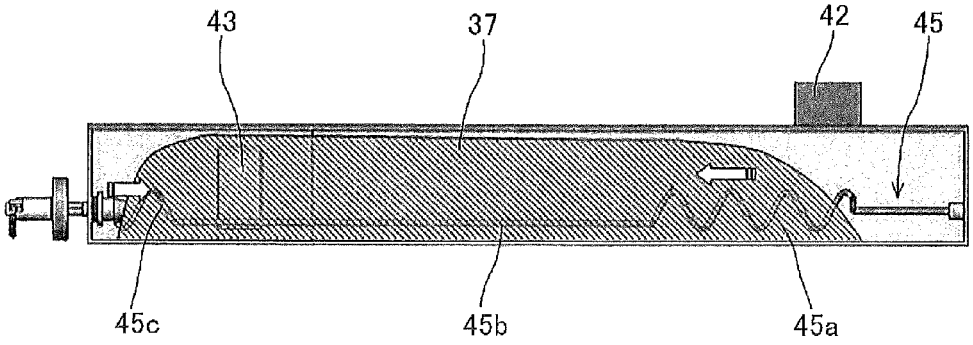
Figure 9A:
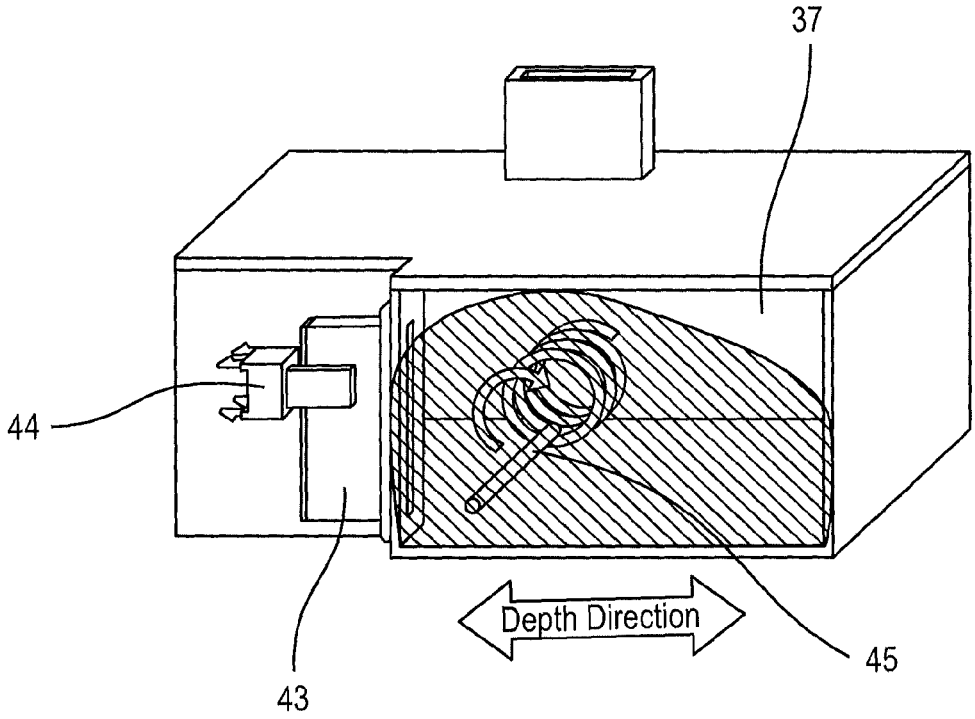
FIGS. 9A and 9B are explanatory views schematically showing a toner and a developer which are recovered in the waste powder recovery container shown in FIGS. 5 to 8C.
Figure 9B:
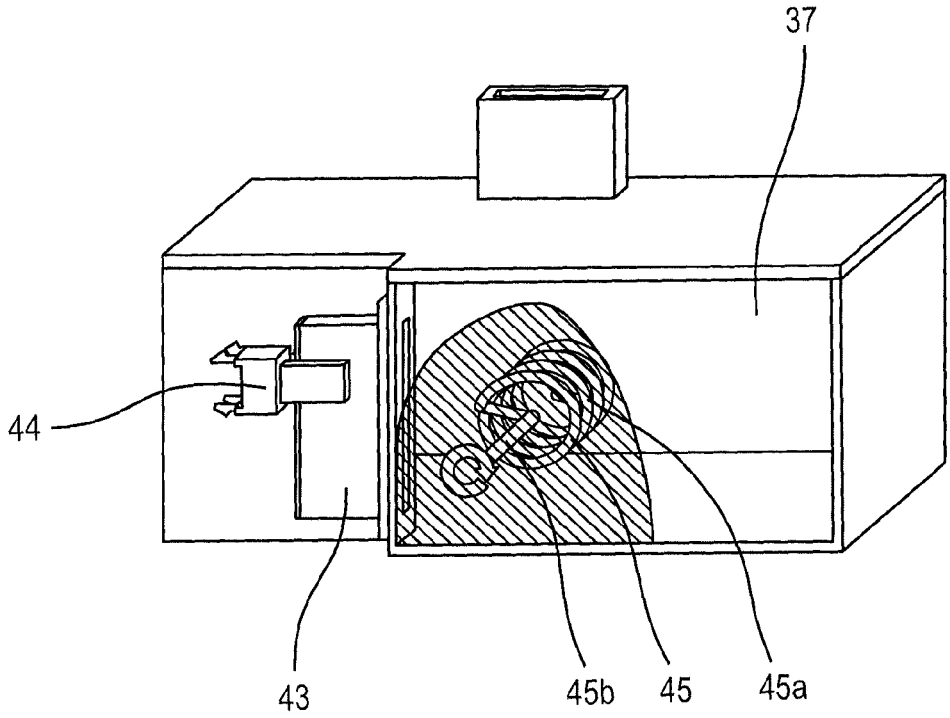

In contrast, in the developer recovery chamber 37, when the developer agitating coil 45 is rotated, the developer recovered through the developer recovery port 42 is conveyed in a longitudinal direction by the first spiral portion 45*a* while being agitated, as shown in FIGS. 8B and 9B. When the developer reaches the straight portion 45*b* formed eccentrically from the rotational center, the developer is dispersed in the widthwise direction, as shown in FIG. 9A. Therefore, even the developer recovery chamber 37 having a width greater than a height can level off the waste developer in the widthwise direction without any unevenness. When the waste developer reaches the straight portion 45*b*, the waste developer is further conveyed to the second spiral portion 45*c* with a thrust from the first spiral portion 45*a* while also being dispersed in the widthwise direction. Since the second spiral portion 45*c* is wound reversely to the first spiral portion 45*a*, a reverse force is exerted on the developer. Consequently, the pressure of the developer acting on the bearing portion is alleviated, as shown in FIG. 8C. Thus, it is possible to prevent any malfunction that the developer leaks outside through the bearing portion or that the developer degrades the rotation support state at the bearing portion to induce insufficient rotation of the developer agitating coil 45.

Thereafter, when the toner recovery chamber 36 is in the "near-full" state, the waste toner detecting sensor 40 detects this state, and then transmits a detection signal to the control unit 8. The control unit 8 determines the "near-full" state based on the detection signal, thereby sending a first notice. Thereafter, when the toner is further recovered in the toner recovery chamber 36, the toner flows down to the developer recovery chamber 37 through the cylindrical portion 46.

When the waste powder recovery container 6 comes to the "near-full" state with the developer recovered through the developer recovery port 42 and the toner flowing down from the toner recovery chamber 36 through the cylindrical portion 46, the waste developer detecting sensor 44 detects that the waste powder recovery container 6 is in the "near-full" state, and then transmits a detection signal to the control unit 8. In other words, the second detector 43 is formed into the elongated and grooved recess extending in the vertical direction, as described above. In addition, the developer being agitated from above to below intrudes into the second detector 43 by the effect of the straight portion 45*b* of the developer agitating coil 45. As a result, the waste developer detecting sensor 44 can readily detect the amount (i.e., a liquid level) of the developer remaining inside the developer recovery chamber 37.

The control unit 8 determines the "near-full" state based on the detection signal transmitted from the waste developer detecting sensor 44, thereby sending a second notice. In this manner, a user can know that the residual capacity inside the waste powder recovery container 6 has further become small after the first notice, and that the waste powder recovery container 6 soon needs to be replaced with a new one. In this case, the control unit 8 may count a time from the first notice to the second notice or the number of times of image formation so as to predict the replacement time of the waste powder recovery container 6. Indication of a prediction result on a display (not shown) enables the user to accurately find the replacement time of the waste powder recovery container 6 for the sake of convenience.

3. Other Embodiments

The present invention is not limited to the configuration exemplified in the above-described embodiment, but may be variously modified and altered.

For example, although the developer agitating coil 45 includes the first spiral portion 45*a*, the straight portion 45*b*, and the second spiral portion 45*c* in the above-described embodiment, the developer agitating coil 45 may include only the first spiral portion 45*a* and the straight portion 45*b*. In this case, the pressure of the developer acting on the bearing portion may be alleviated by disposing a magnet in the bearing portion or the like.

Alternatively, although the detectors 39 and 43 are disposed in the recovery chambers 36 and 37 in the waste powder recovery container 6, respectively, in the above-described embodiment, the detector may be disposed only in the recovery chamber 37 in the lower portion. Specifically, the toner recovery chamber 36 first comes to the "near-full" state, and the toner to be recovered thereafter flows down to the developer recovery chamber 37 through the cylindrical portion 46. Therefore, the replacement time can be properly determined without needlessly using the recovery space inside the developer recovery chamber 37 only by detecting whether or not the developer recovery chamber 37 is in the "near-full" state with the recovered developer and the flowing-down toner.

What is claimed is:

1. A waste powder recovering device provided with a waste powder recovery container, the device comprising:

a recovery port, through which a waste powder is recovered, formed at one end of the waste powder recovery container; and a conveying member for conveying the waste powder, which has been recovered through the recovery port, from one end to the other end, the conveying member disposed inside the waste powder recovery container, wherein the conveying member includes a first conveying portion positioned on a side of the recovery port, for conveying the waste powder to the other end, and a second conveying portion for dispersing the waste powder conveyed by the first conveying portion in a widthwise direction, the second conveying portion coupled to and moved by the first conveying portion.

2. A waste powder recovering device according to claim 1, wherein the conveying member is made of a wire rod rotatably supported at both ends thereof by both ends of the waste powder recovery container, the first conveying portion being configured by a spiral portion obtained by bending the wire rod into a spiral form, and the second conveying portion being configured by a straight portion disposed eccentrically from the rotational center of the conveying member.

3. An image forming apparatus comprising the waste powder recovering device according to claim 2.

4. A waste powder recovering device according to claim 1, wherein the waste powder recovering container includes a powder detecting member formed into an elongated and grooved recess extending in a vertical direction at a side opposite to the recovery port and detecting the waste powder which is dispersed in the widthwise direction by the second conveying portion and is contained into the recess while being agitated from above to below; and a determining member for determining whether or not the waste powder is contained up to a predetermined level inside the waste powder recovering container based on a detection result by the powder detecting member.

5. An image forming apparatus comprising the waste powder recovering device according to claim 4.

6. An image forming apparatus comprising the waste powder recovering device according to claim 1.

7. A waste powder recovering device according to claim 1, wherein the second conveying portion includes a portion projecting radially from a rotational center of the conveying member.

8. A waste powder recovering device according to claim 7, wherein the second conveying portion is disposed eccentrically from the rotational center of the conveying member.

9. A waste powder recovering device according to claim 7, wherein the second conveying portion is rotated with the first conveying portion.

10. A waste powder recovering device provided with a waste powder recovery container, the device comprising:

a recovery port, through which a waste powder is recovered, formed at one end of the waste powder recovery container; and a conveying member for conveying the waste powder, which has been recovered through the recovery port, from one end to the other end, the conveying member disposed inside the waste powder recovery container, wherein:

the conveying member includes a first conveying portion positioned on a side of the recovery port, for conveying the waste powder to the other end, and a second conveying portion for dispersing the waste powder conveyed by the first conveying portion in a widthwise direction, the conveying member is made of a wire rod rotatably supported at both ends thereof by both ends of the waste powder recovery container, the first conveying portion being configured by a spiral portion obtained by bending the wire rod into a spiral form, and the second conveying portion being configured by a straight portion disposed eccentrically from the rotational center of the conveying member, and the conveying member further includes a second spiral portion which is positioned on a side opposite to the recovery port and wound reversely to the spiral portion.

11. An image forming apparatus comprising the waste powder recovering device according to claim 10.

12. A waste powder recovering device provided with a waste powder recovery container, the device comprising:

a recovery port, through which a waste powder is recovered, formed at one end of the waste powder recovery container; and a conveying member for conveying the waste powder, which has been recovered through the recovery port, from one end to the other end, the conveying member disposed inside the waste powder recovery container, wherein:

the conveying member includes a first conveying portion positioned on a side of the recovery port, for conveying the waste powder to the other end, and a second conveying portion for dispersing the waste powder conveyed by the first conveying portion in a widthwise direction, and the waste powder recovering container is vertically bisected, an upper space being a toner recovery chamber, into which a toner is recovered, and a lower space being a developer recovery chamber, into which a developer is recovered and in which the recovery port and the conveying member are housed.

13. An image forming apparatus comprising the waste powder recovering device according to claim 12.

* * * * *